US005382080A

United States Patent [19]

Gamberini et al.

[11] Patent Number: 5,382,080

[45] Date of Patent: Jan. 17, 1995

[54] CHAIR

[75] Inventors: Gino Gamberini, Via Santi No. 8, Toscanella (Bologna); Carlo Casuccio, Ivrea, both of Italy

[73] Assignee: Gino Gamberini, Toscanella, Italy

[21] Appl. No.: 909,233

[22] Filed: Jul. 6, 1992

[30] Foreign Application Priority Data

Jul. 4, 1991 [IT] Italy ..... TO91 A 000515

[51] Int. Cl.[6] ..... A47C 7/00

[52] U.S. Cl. ..... 297/440.1; 297/440.13; 297/338; 297/258

[58] Field of Search ..... 297/440, 442, 160, 194, 297/258, 263–265, 272, 338, 345

[56] References Cited

U.S. PATENT DOCUMENTS

| | | | |
|---|---|---|---|
| 3,982,785 | 9/1976 | Ambasz | 297/160 |
| 4,240,663 | 12/1980 | Locher | 297/338 X |
| 4,736,984 | 4/1988 | Tacker | 297/264 |
| 5,139,309 | 8/1992 | Kornreich | 297/194 |
| 5,167,436 | 12/1992 | Wu | 297/440 X |
| 5,178,438 | 1/1992 | Beger | 297/258 |
| 5,222,783 | 6/1993 | Lai | 297/345 X |

FOREIGN PATENT DOCUMENTS 0131553 1/1985 European Pat. Off. .

*Primary Examiner*—Peter M. Cuomo
*Assistant Examiner*—Suzanne L. Dino
*Attorney, Agent, or Firm*—Richard M. Goldberg

[57] ABSTRACT

Chair including a base structure, a seating structure having a seat of predetermined depth and a connecting structure for connecting the base structure and the seating structure. The base structure and the seating structure each include two coupling parts which extend along corresponding extension axes, and the connecting structure includes two connecting nuclei at the sides of the two structures, having a limited depth with respect to the depth of the seat. Each connecting nucleus includes two coupling counter slots which may interlock with the two coupling parts of the base structure and with the two coupling parts of the seating structure, respectively, along the extension axes of the above-mentioned coupling parts.

19 Claims, 15 Drawing Sheets

CHAIR

BACKGROUND OF THE INVENTION

This invention refers to a chair comprising:
a base structure
a seating structure with a seat of a predetermined depth, means for connecting the two structures

DESCRIPTION OF THE PRIOR ART

This type of chair is known from European patent application n. 0 131 553, in which the base structure includes two pairs of tubular legs, in the shape of an upside-down "V" and attached at the top to two reinforcement supports connected by a cross-piece. The seating structure includes a seat and a backrest, supported by two levers and two side arms, respectively. The connection means include fulcrum joints and springs connecting the levers and arms to the supports and to each other. This chair is rather complicated and therefore costly due to the number and structure of the joints, which require a high degree of workmanship and difficult assembly.

SUMMARY OF THE INVENTION

The technical problem of the present invention is to build a chair that is simple, in which the connections between the base structure and the seating structure allow different types of chairs to be manufactured with rapid assembly, which is highly reliable and low in cost.

This problem is solved by the chair in this invention, which is characterized by the fact that the base structure and the seating structure each include two coupling parts which extend along corresponding extension axes, and the connection means include two connection nuclei arranged on the sides of the two structures and having limited depth with respect to the seat depth, and in which each connection nucleus includes two interlocking counter slots for coupling with the two coupling parts of the base structure and the two coupling parts of the seating structure, respectively, along the extension axes of the two coupling parts.

BRIEF DESCRIPTION OF THE DRAWINGS

These and other features will become obvious through the following description, referring to a preferred form of execution for the invention, made for purposes of exemplification but not constituting limitations, and with reference to the attached drawings in which.

DETAILED DESCRIPTION OF THE INVENTION

Chair With Fixed Seat

Figure 1:
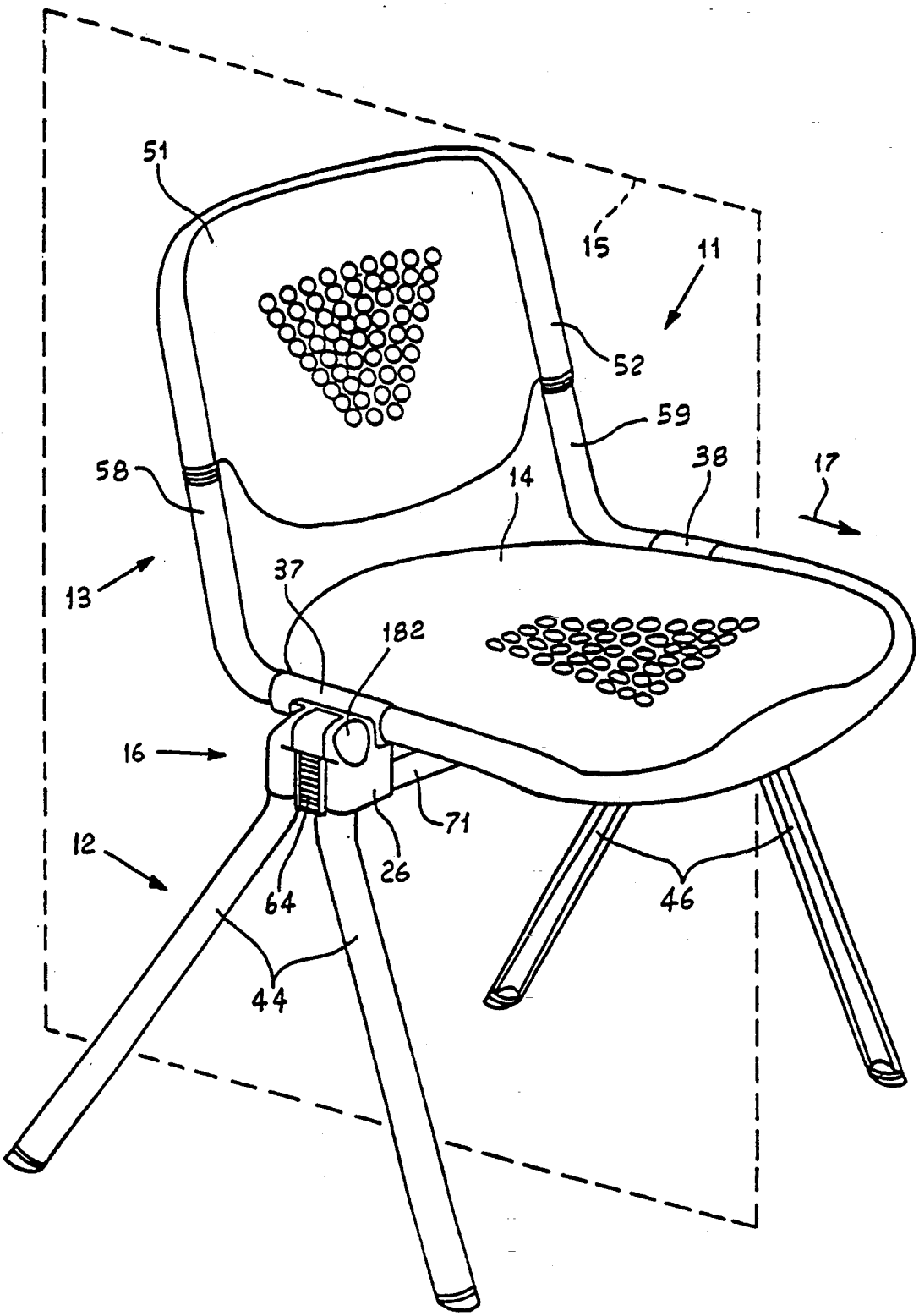
FIG. 1 represents a perspective view of a chair according to the invention.

With reference to FIGS. 1, 2, 3 and 4, a chair is generically indicated by the number 11 and includes a base structure 12, a seating structure 13 with a seat 14 and means 16 to connect the two structures 12 and 13, symmetrical with respect to a vertical geometric symmetry plane 15. To make the description clearer and avoid misunderstandings in interpretation, the term forward or front or depth refers to the direction indicated by the arrow 17, the term back or rear refers to the opposite direction, the term side or horizontal refers to a direction perpendicular to the vertical symmetry plane 15 of the chair 11.

The base structure 12 and the seating structure 13 each include two coupling parts 18 and 19, 21 and 22 which in the preferred form of execution protrude and extend along corresponding base coupling axes 23 and seating coupling axes 24. The means of connection 16 include two connection nuclei 26 and 27, approximately parallelepipedal in shape and placed at the sides of the two structures 12 and 13. The seat 14 has a depth according to the usual standards of approximately 50 cm., and each nucleus has a corresponding depth of approximately 9 cm., a height of approximately 10 cm., and a horizontal measurement of approximately 5 cm., limited with respect to the depth of the seat 14. Satisfactory results can also be achieved with a nucleus depth contained within the ratio of 0.15–0.25 with respect to the depth of the seat. The two nuclei 26 and 27 are substantially identical and interchangeable, and thus to simplify the description the details given refer to a single nucleus.

Each nucleus 26, 27 includes two coupling counter slots 28 and 29, interlocking respectively with the two coupling parts 18 and 19 of the base structure 12 and with the coupling parts 21 and 22 of the seating structure 13 along the axes 23 and 24 of the above coupling parts 18 and 19, 21 and 22. Each connecting nucleus 26, 27 consists of a single piece of metal, mainly a press-molded aluminum alloy, having a lower surface 31 in which the two coupling counter-parts 18 and 19 of the base structure 12 are fit and an upper surface 32 in which the two coupling counter-parts 21 and 22 of the seating structure 13 are made. The lower surface 31 and the upper surface 32 are parallel. In the form of execution in which the coupling parts protrude, the two coupling counter slots 28 and 29 associated with the lower surface 31 and the upper 32 receive coupling parts 18 and 19, 21 and 22.

The base structure 12 includes a cross-piece 33 with the coupling parts 18 and 19 at either end. These parts each include two pins which, in use, extend upward to fit into the two cylindrical slots 28 of the lower surface 31. The cross-piece 33 consists, for example, of two hollow longitudinal profiles 34 and two horizontal hollow profiles 36, attached in a known manner, for example through welding.

The seating structure 13 includes, at the sides of the seat 14, the two coupling parts 21 and 22, which each include a fixed intermediate piece 35, 40 in a "$\pi$" shape, fitted with two pins which, in use, extend downward to fit into the two cylindrical slots 29 of the upper surface 32. The axes 23 and 24 are parallel in use, and basically vertical. The seat 14 consists of a seat with two tubular side borders 37 and 38. Each pair of pins 21, 22 of pieces 35, 40 is attached to a tab 39, 41 with a concave upper part, complementary to the section of borders 37 and 38 and attached at the bottom to the borders 37 and 38 of the seat 14 by means of screws 42. Known attachment means, for example screws 43, are used to lock the pins 18 and 19 of the base structure 12 in the lower slots 28 of the nuclei 26 and 27, and the pins 21 and 22 of the seating structure 13 in the upper slots 29 of the nuclei 26 and 27.

Figure 5:
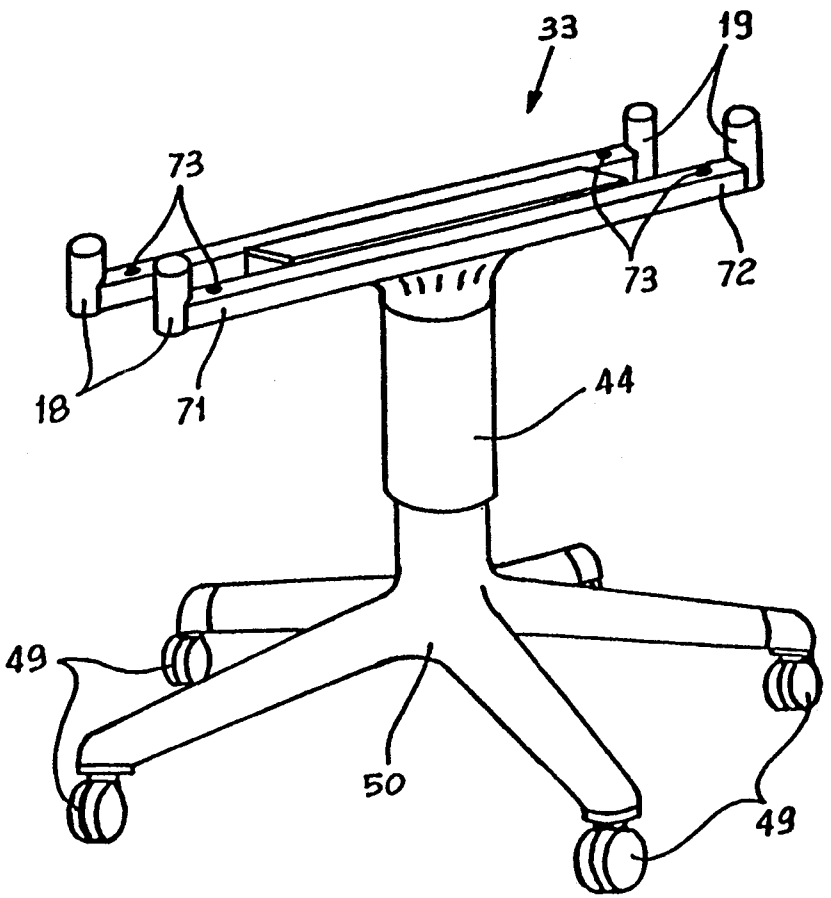
FIG. 5 represents a partial perspective view of a first variation of a chair according to the invention.
Figure 6:
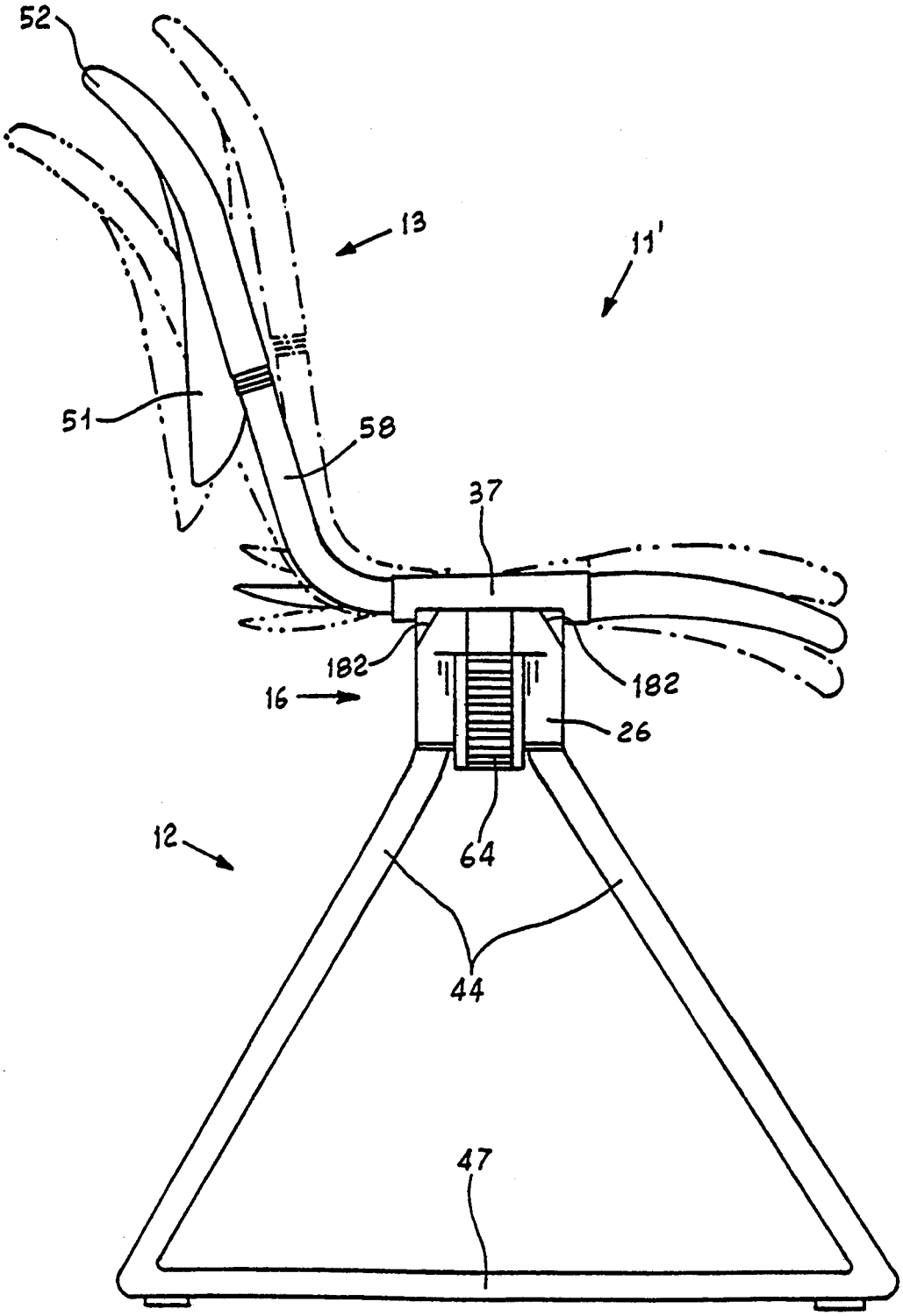
FIG. 6 represents a side view of a second variation of a chair according to the invention.
Figure 7:
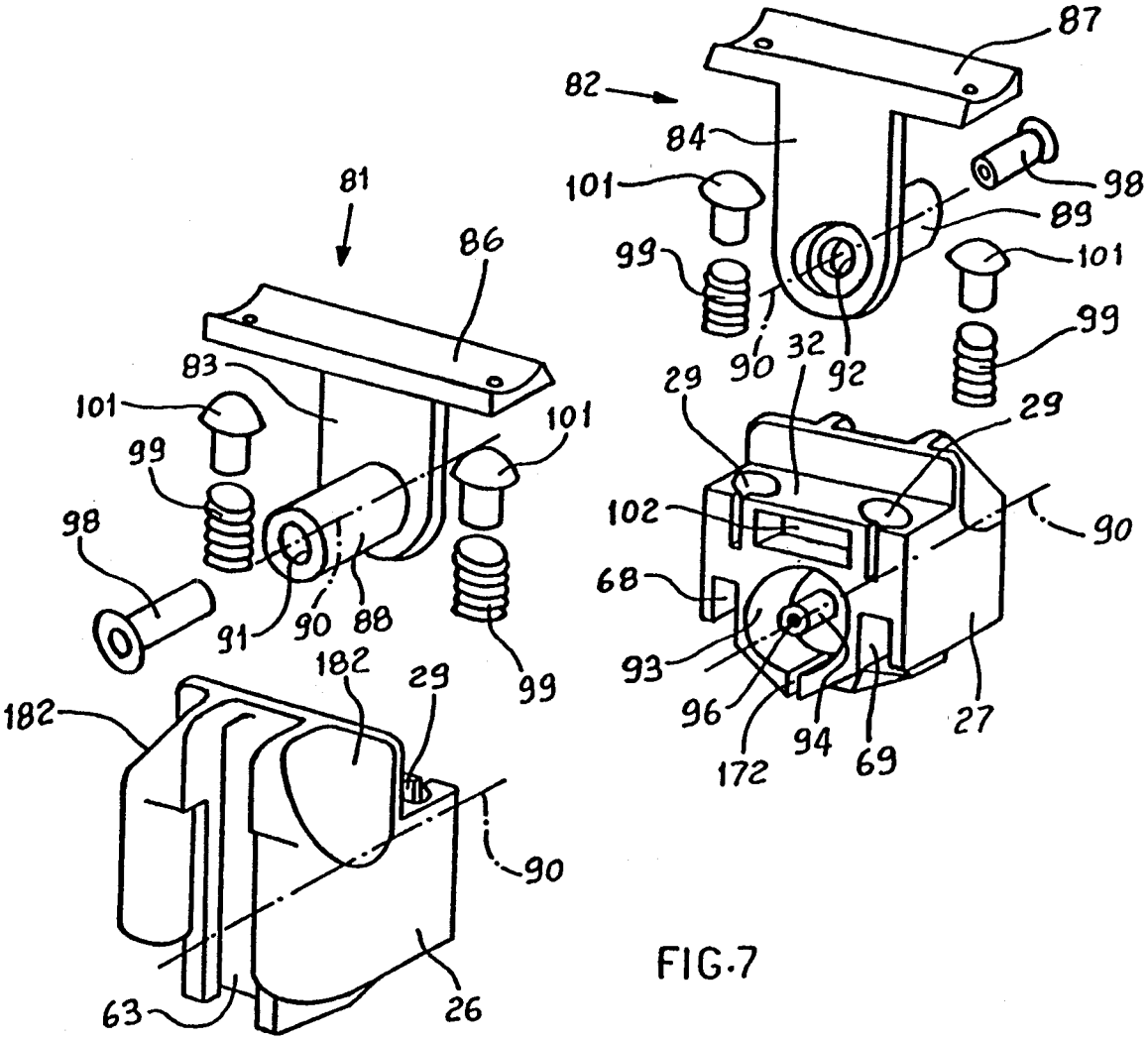
FIG. 7 represents an exploded perspective view of some details of FIG. 6.
Figure 8:
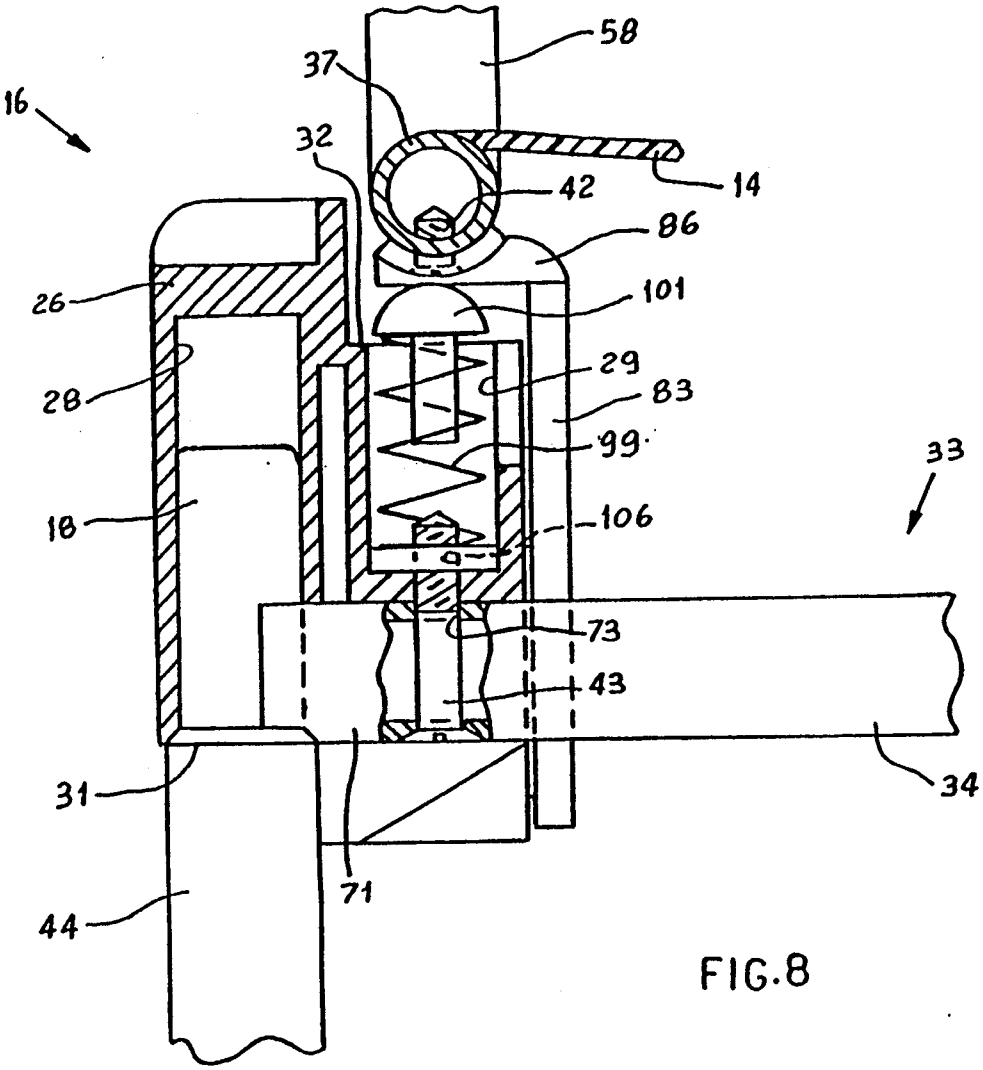
FIG. 8 represents a partial front section of some details of FIG. 6.
Figure 9:
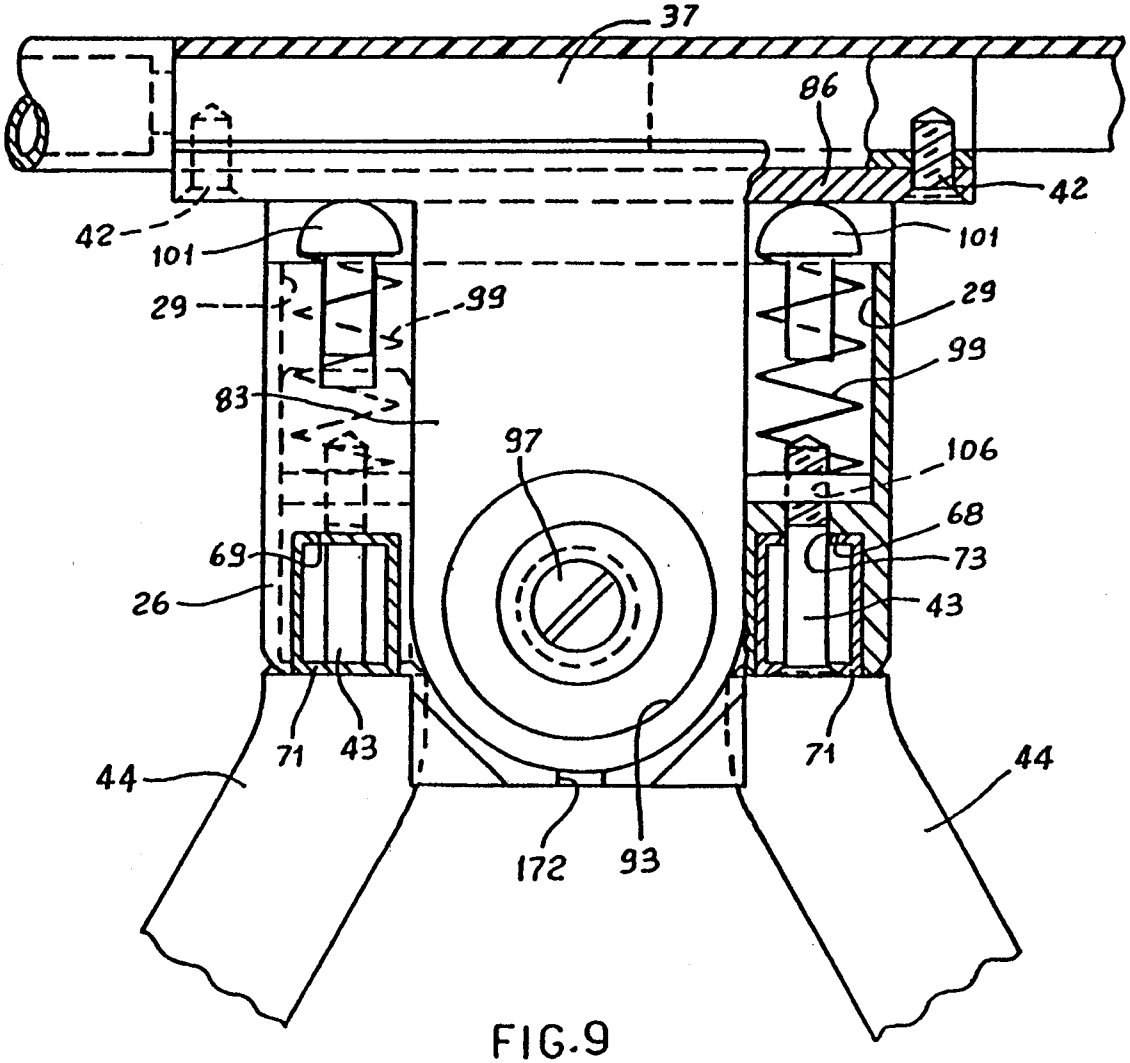
FIG. 9 represents a partial side view of FIG. 8.

The base structure 12 includes two pairs of tubular legs 44 and 46, attached to the lower parts of pins 18 and 19, respectively. The pairs of legs 44 and 46 can be made from four separate profiles, as represented in FIG. 1, or can be made from only two profiles in such a way as to be connected via a section 47 as shown in FIG. 6. Alternatively, the cross-piece 33 can be attached to a rotating pedestal 44 with respect to a base 50, in turn rolling on casters 49 as shown in FIG. 5. The legs 44 and 46 and the pedestal 44 in FIGS. 1, 5 and 6 are shown merely as examples, but do not limit from any other possible solutions.

The seating structure 13 (FIGS. 1, 2, 3 and 4) includes a backrest 51 edged by a tubular border 52 from which two side pins 53 and 54 protrude, jointed with return springs to allow the backrest to be inclined. These pins fit into the corresponding cylindrical slots 56 and 57 on two side support arms 58 and 59. Each support arm 58 and 59 is profiled at a nearly right angle, and has a protruding cylindrical pin 61, 62 on the front which fits into the side border 37, 38 of the seat 14, and may be attached to it by means of the screws 42.

Figure 2:
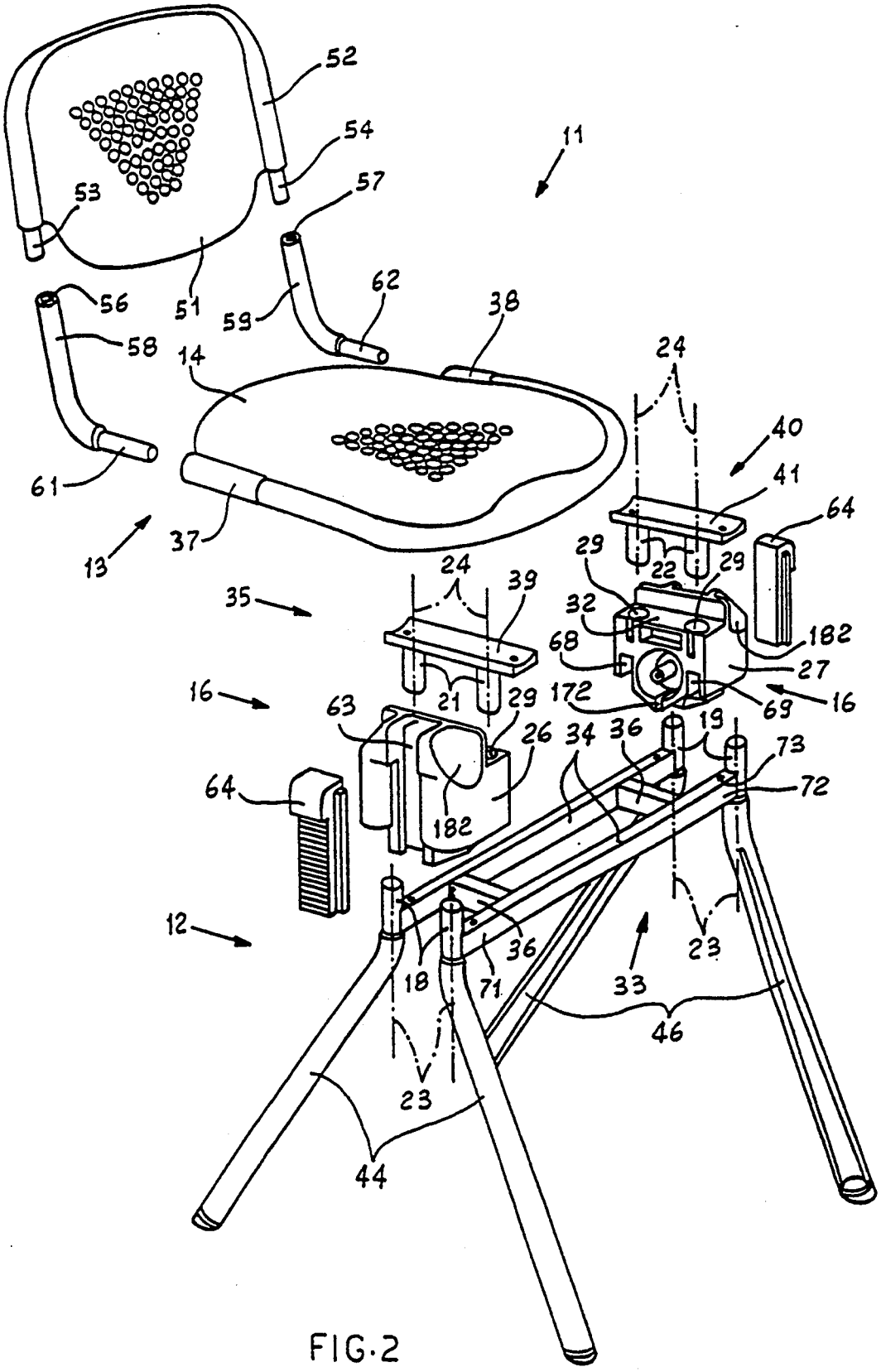
FIG. 2 represents an exploded perspective view of the chair in FIG. 1.
Figure 3:
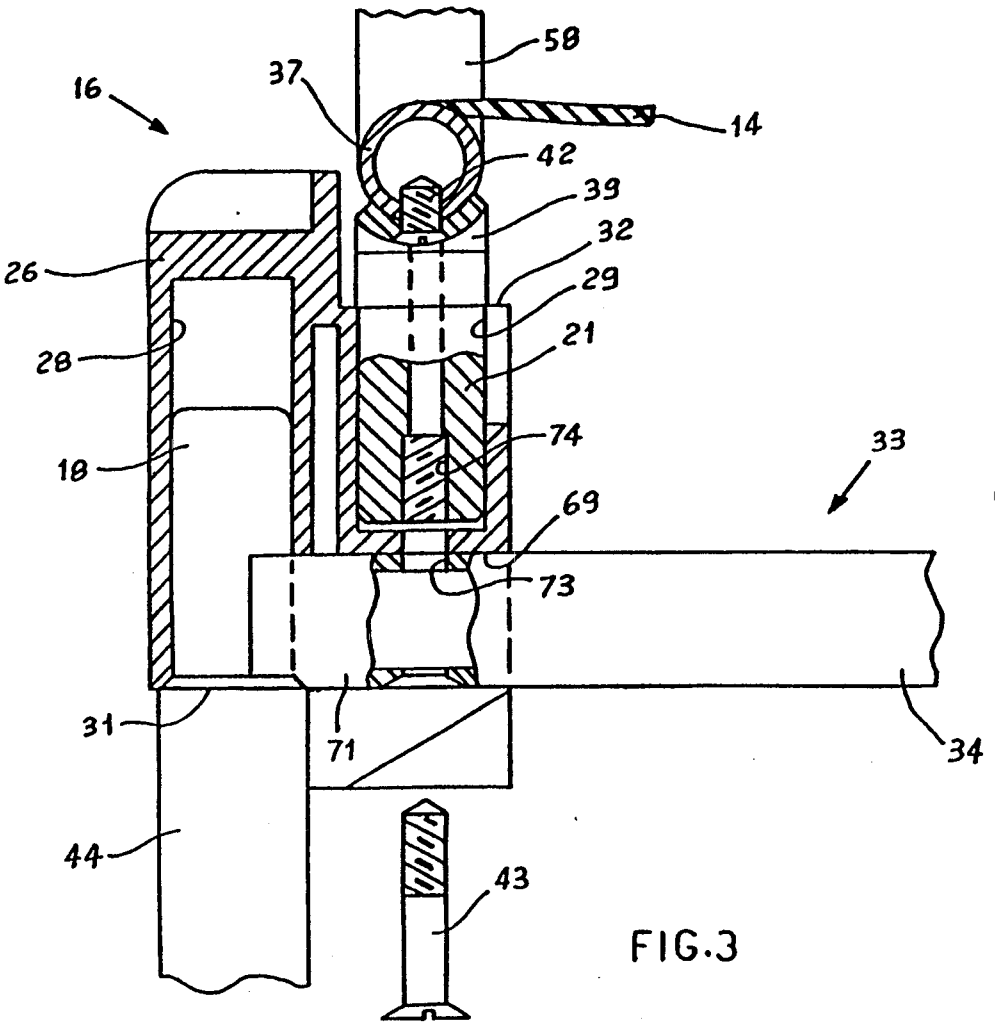
FIG. 3 represents a partial front section of some details of FIG. 2.
Figure 4:
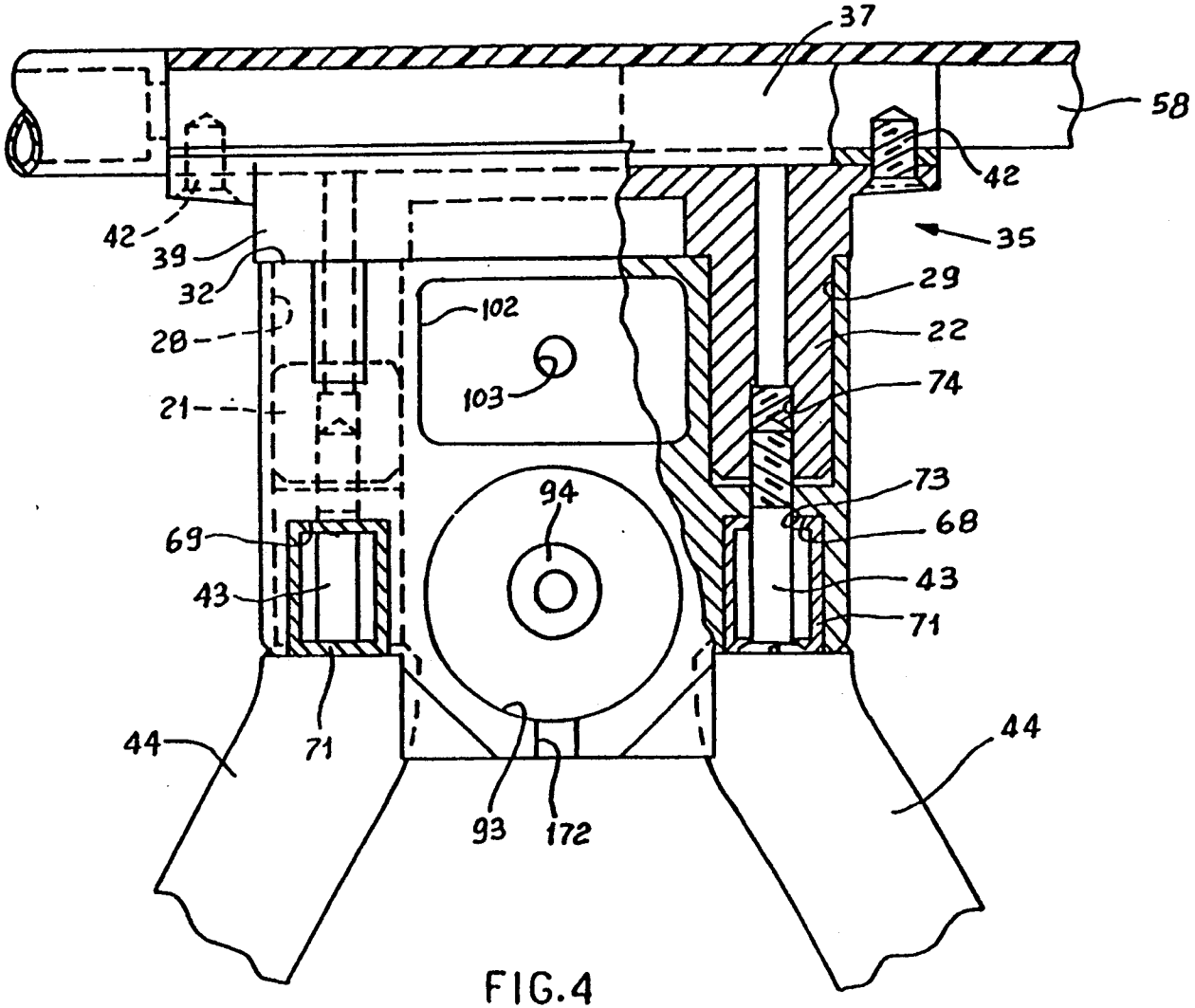
FIG. 4 represents a partial side view of FIG. 3.

The two connecting nuclei 26 and 27 each include a vertical groove 63, parallel to the cylindrical slots 28 and 29, for the purpose of holding a closing element 64 as shown in FIGS. 1 and 2, or alternatively a support and clasping element 66, 67 (FIG. 10) as described below. Each nucleus 26, 27 (FIGS. 1, 2, 3 and 4) also includes two side grooves 68 and 69, parallel to each other and perpendicular to the cylindrical slots 28 and 29, which have the purpose of housing the ends 71 and 72 of the cross-piece 33.

The chair is assembled as follows:

Each connecting nucleus 26, 27 with slots 28 is positioned along the axes 23 aligned with the pins 18, 19, and is lowered so that the pins 18, 19 fit into the slots 28. By pressing lightly towards the base structure 12, the nucleus 26, 27 is lowered until the ends 71, 72 are housed and strike against the back of the side grooves 68 and 69. The pins 18 and 19 are then completely fitted into the slots 28, and the lower surface 31 is in contact with the upper end of the legs 44, 46.

The seating structure 13 is assembled by connecting the backrest 51 to the side arms 58 and 59, inserting the pins 53 and 54 into the slots 56 and 57, and fastening the unit in place using screws or holding pegs not shown in the drawings. Next the pins 61 and 62 of the side arms 58 and 59 are fitted into the side borders 37 and 38 of the seat 14, and the intermediate parts 35, 40 are attached to the borders 37, 38, positioning the tabs 39 and 41 against the lower surfaces of the side borders 37 and 38, and holding the seat 14, the side arms 58 and 59 and the tabs 39 and 41 in place by means of the screws 42. The pins 21 and 22 are thus firmly attached to the seat 14.

The seating structure 13 is then positioned with the pins 21 and 22 aligned with the slots 29 in the upper surfaces 32 of the nuclei 26 and 27. The pins 21 and 22 are fitted into the slots 29 and lightly pressed towards the base structure 12 to lower the seating structure 13 until the lower surfaces of the tabs 39 and 41 stop against the upper surfaces 32 of the nuclei 26 and 27. The screws 43 are inserted into the through-holes 73 of the ends 71 and 72 of the cross-piece 33 until firmly inserted, and pins 21 and 22 are screwed into the threaded slots 74. Next the closing element 64 is positioned in the groove 63.

The chair is thus fully assembled.

This chair 11 has its seating structure 13 firmly attached to the base structure 12.

Chair With Rocking Seat

Now we shall describe a variation of the chair indicated by 11', in which the seating structure 13 can rock with respect to the base structure 12. This is achieved by changing a minimal number of parts with respect to those of the chair 11, thus most parts are common to both chairs 11 and 11'. The same numerical references are therefore used, and the operation described above is recalled. In addition, for this chair 11' the legs can be of a different type as described above in reference to FIGS. 1, 5 and 6.

The chair 11' (FIGS. 2, 6, 7, 8, 9 and 10) includes the base structure 12, the seating structure 13 and the connecting means 16 including the connecting nuclei 26 and 27 already described in reference to the chair 11. The base structure 12 includes the cross-piece 33 with the coupling pins 18 and 19 at the ends 71 and 72, for the purpose of fitting into the cylindrical slots 28 of the lower surfaces 31 of the nuclei 26 and 27 along the vertical base coupling axes 23.

The seating structure 13 of the chair 11' also includes the seat 14 and the backrest 51 connected to the side arms 58 and 59 fitted into the side borders 37 and 38 of the chair 14. In the chair 11', the connection between the seating structure 13 and the nuclei 26 and 27 is instead made using two "T"-shaped intermediate rocking pieces, indicated as 81 and 82, by means of a coupling which rotates along the respective horizontal seat coupling axes 90, aligned and perpendicular to the plane of symmetry, which allows the seating structure, 13 a limited freedom of oscillation.

Each piece 81 and 82 includes a central drum 83, 84 and a flange 86, 87 which protrudes on one side and has a concave upper portion, for the purpose of being attached against the lower surface of the tubular side borders 37 and 38 of the seat 14 by means of the screws 42. The drum 83, 84 has a sleeve 88, 89 protruding on the same side as the flange 86, 87 and with a cylindrical slot 91, 92. Each connecting nucleus 26, 27 has a side surface in which a slot 93 is made to house the sleeve 88,

89, and a pin 94 which may be coupled to the cylindrical slot 91, 92. The slot 93 is positioned in the center of the nucleus 26, 27 between the two side grooves 68 and 69.

Each pin 94 has a threaded internal slot 96 in which a screw 97 is inserted to fasten and prevent the sleeve 88, 89 from sliding out of the slot 93. To prevent gripping between the cylindrical slot 91, 92 of the sleeve 88, 89 and the pin 94 during assembly, as described below, a bushing 98 of grip-proof material is inserted on the pin 94.

Flexible means consisting of four springs 99, positioned in the two slots 29 of the nucleus 26 and in the two slots 29 of the nucleus 27 act on the lower surfaces of the flanges 86 and 87 by means of four small pistons 101. Each spring 99 is pre-loaded to allow the seating structure 13 to rock slightly from the normal position, represented by a solid line in FIG. 6, to the two extreme rocking positions shown: one represented by a dot and line and the other represented by two dots and a line.

Each connecting nucleus 26, 27 has a housing 102 above the slot 93 and positioned between the two vertical slots 29 of the upper surface 32, with a hole 103 for the purpose of allowing the passage of a screw 104 to attach the elements 64, 66 and 67.

The closing element 64 has only an aesthetic function, to close the groove 63, and thus since it need not work together with the other parts it may also not be attached, while the support and clasping elements 66 and 67 must work together with the other parts as described below, and therefore are appropriately fastened in place by the screws 104 after being inserted in the grooves 63.

The chair 11' is assembled as follows.

Figure 10:
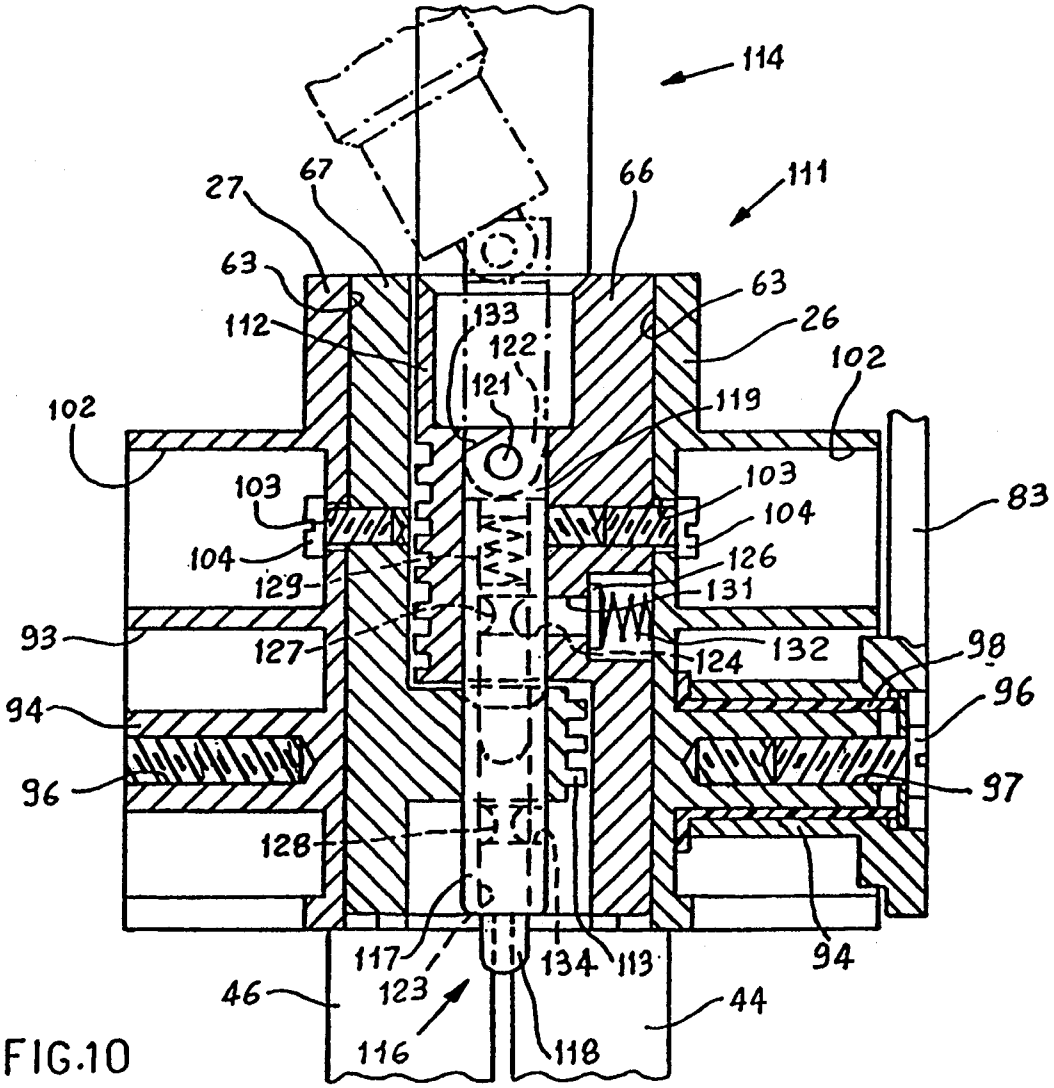
FIG. 10 represents a partially sectioned front view of a method of applying the chair according to the invention.
Figure 11:
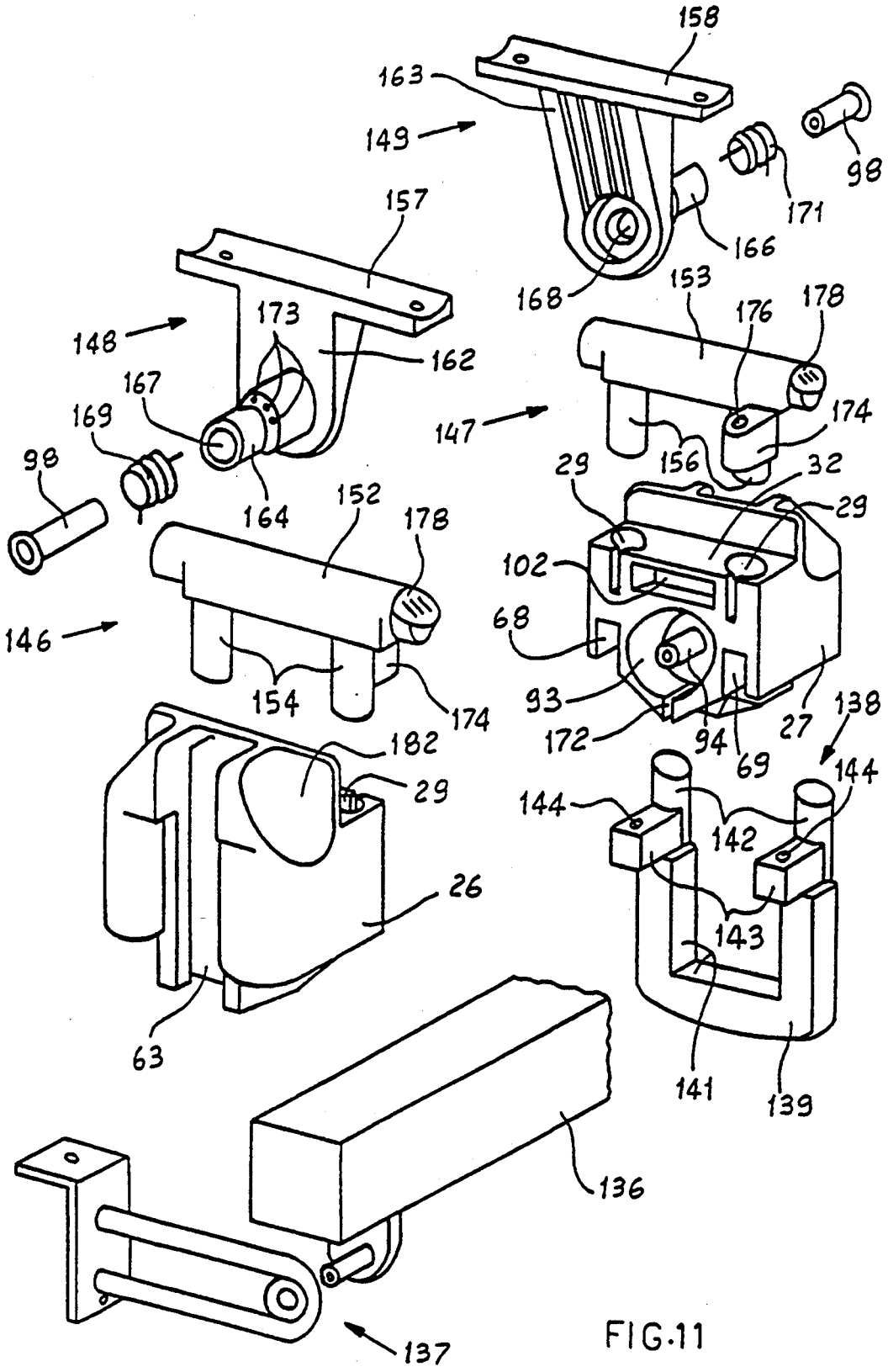
FIG. 11 represents an exploded perspective view of some details of a third variation of a chair according to the invention.
Figure 12:
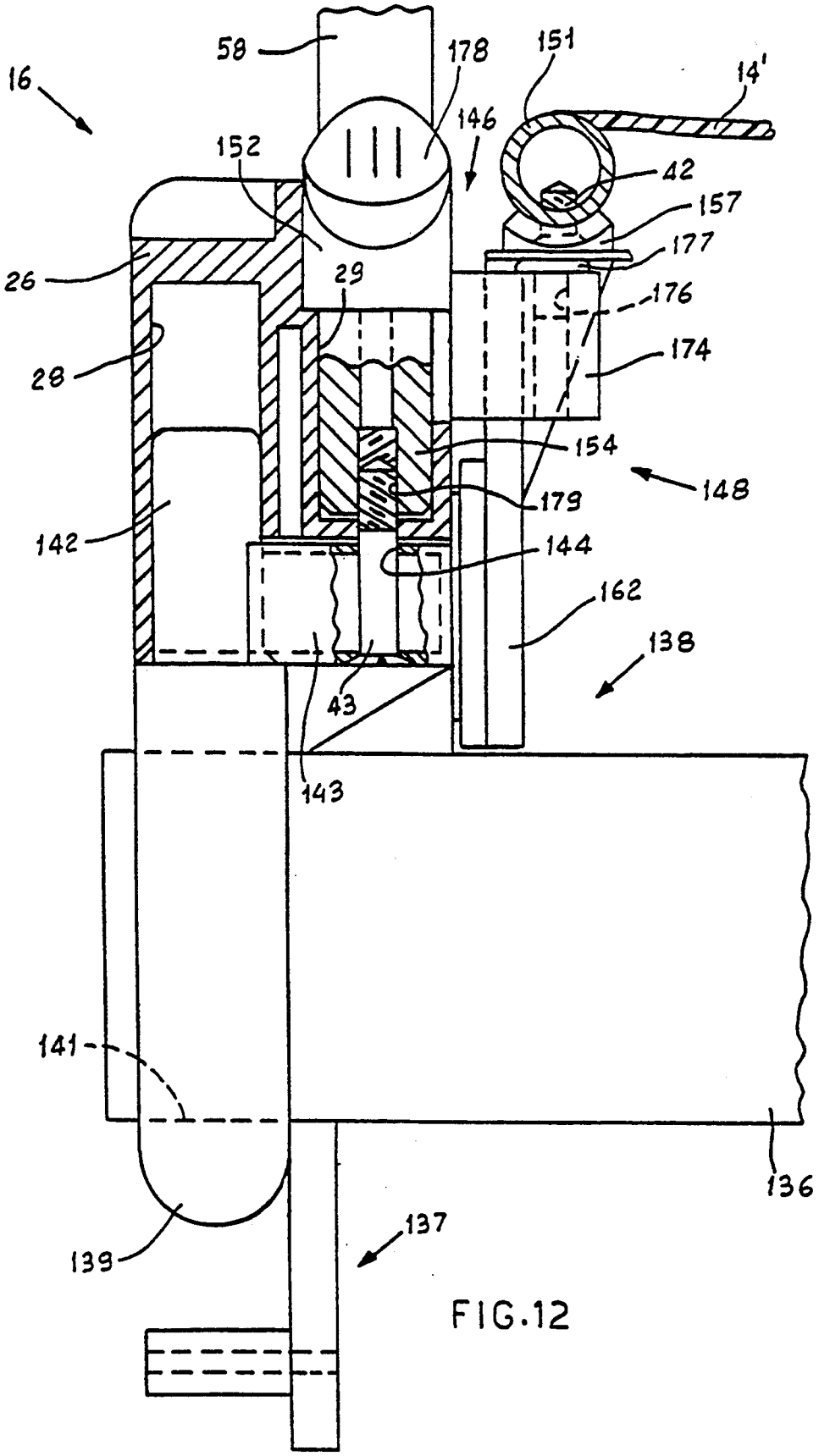
FIG. 12 represents a partial front view of some details of FIG. 11.
Figure 17:
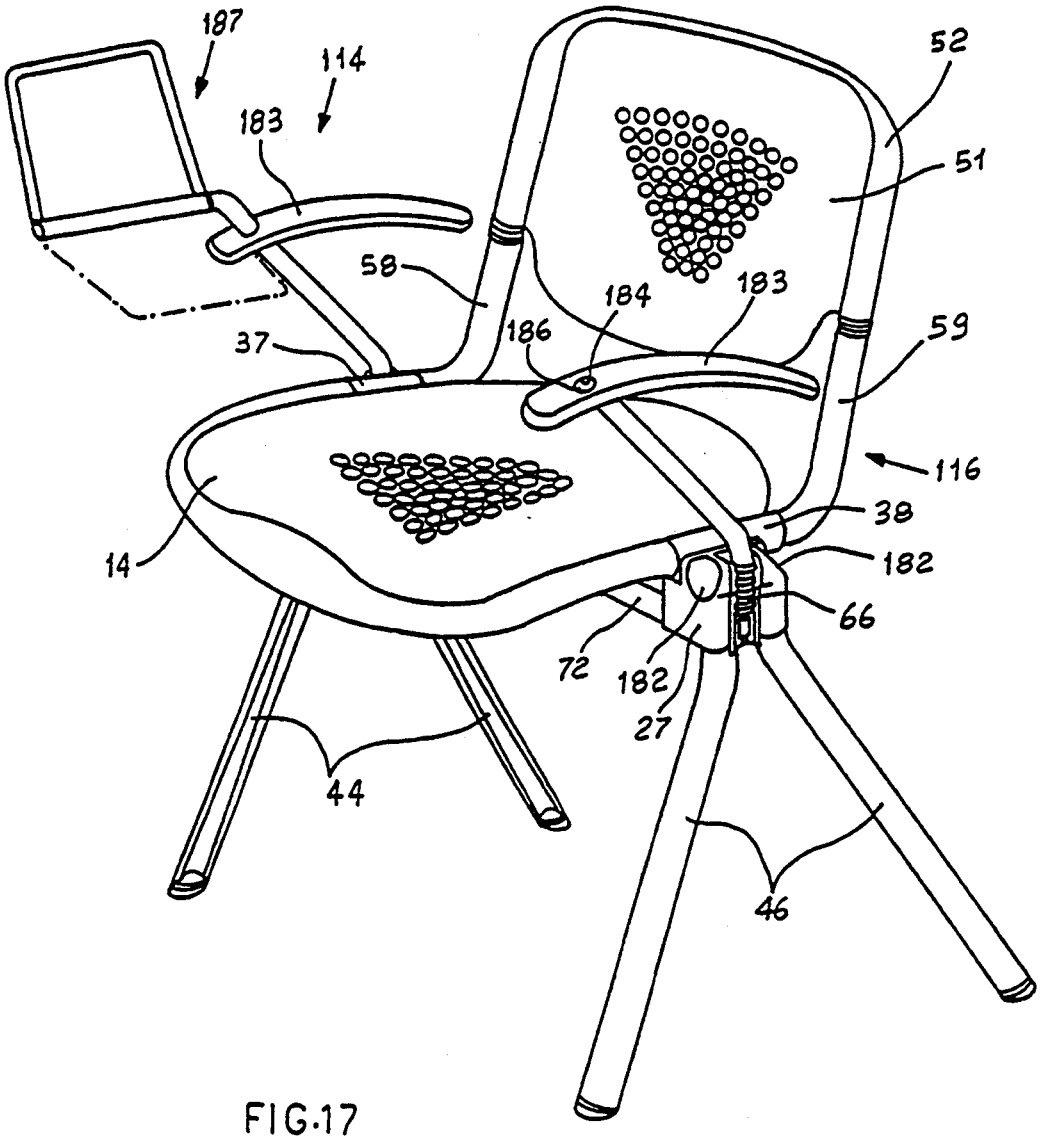
FIG. 17 represents a perspective view of a method of applying the chair according to the invention.

A support and clasping element 66 is inserted in the grooves 63 of each nucleus 26, 27 to achieve performance as shown in FIG. 17, or a support and clasping element 66 is inserted in the groove 63 of the first nucleus 26 and a support and clasping element 67 in the groove 63 of the second nucleus 27 to achieve performance as shown in FIG. 10. Both types of performance are described in detail below. The support and clasping elements 66, 67 are attached in place by means of the screws 104, and then the bushing 98 (FIGS. 2, 6, 7, 8, 9 and 10) is mounted on the pin 94 of each nucleus 26, 27.

The springs 99 are mounted on each nucleus 26, 27 with the small pistons 101 in the slots 29 of the upper surface 32, and a special tool is used to pre-load the springs 99.

Each rocking piece 81, 82 is assembled, positioning the sleeve 88, 89 aligned with the slot 93, and then the cylindrical slot 91, 92 slides onto the bushing 98. The equipment which causes the small pistons 101 to be pushed by the springs 99 against the lower surface of the flange 86, 87 is then removed. Finally, the screw 97 is screwed into the threaded slot 96, thus the piece 81, 82 can rotate around the axis 90 but cannot separate from its pin 94.

The backrest 51 is connected to the side arms 58 and 59 and then to the side borders 37 and 38 of the seat 14 as described for the chair 11. The seating structure 13 is positioned with the lower surfaces of the side borders 37 and 38 over the flanges 86 and 87, and the entire unit is fastened with the screws 42. The seating structure 13 is thus connected to the two connecting nuclei 26 and 27.

The seating structure 13 is positioned with the nuclei 26 and 27 in such a way that the slots 28 of the lower surfaces 31 are aligned with the pins 18 and 19, and it is lowered so that the pins 18 and 19 fit into the slots 28. Pressing slightly towards the base structure 12, the seating structure 13 is lowered further until the ends 71 and 72 are housed and strike against the bottom of the side grooves 68 and 69, and the pins 18 and 19 are fully housed in the slots 28. As with the chair 11, the screws 43 are inserted in the through holes 73 of the ends 71 and 72 of the cross-piece until fitted in, and screwed into the threaded slots 106. The chair 11' is now fully assembled.

Variations

The chair 11 in FIG. 1 and the chair 11' in FIG. 6 can be used for collective areas for multi-purpose uses, in which several chairs are connected in rows through a clasping system indicated as 111 (FIGS. 1, 2, 6, 10 and 17). It should be mentioned that the base structure 12 may have the legs 44 and 46 in FIG. 1 or those in FIG. 6.

The clasping system 111 includes the support and clasping element 66 fitted into the groove 63 of the nucleus 26 of the first chair, with a complementary part 112 and the support and clasping element 67, fitted into the groove 63 of the nucleus 27 of a second chair adjacent to the first chair, with a complementary part 113. An armrest 114 with a clasping element 116 works together with the complementary part 112 and the complementary part 113 to keep the first chair permanently attached to the second chair.

The support and clasping element 66 consists of a single metal part, nearly prismatic, with the complementary part 112 consisting of a hollow sleeve, which protrudes at the side and is positioned in the upper part of the element 66. The support and clasping element 67 consists of a single metal piece, nearly prismatic, with the complementary part 113 consisting of a hollow sleeve, which protrudes at the side and is positioned in the lower part of the element 67. Moving the first chair next to the second chair, the two sleeves 112 and 113 are vertically concentric and allow the clasping element 116 to be inserted in order to fasten the two chairs together.

The clasping element 116 includes a hollow cylinder 117 in which a small piston 118 slides. The cylinder 117 has a fork 119 at one end, connected to a fin 122 of the armrest 114 by means of a pin 121, and at the other end a hole 123 for the passage of the piston 118. The cylinder 117 has a cross-hole 124 for the passage of a positioning pin 126.

The positioning pin 126 is guided in a hole 131 of the support and clasping element 66, and a spring 132 keeps it pushed against the small piston 118. The rounded end of the positioning pin 126 never touches the back of the grooves 127 and 128 because it would be difficult to remove in this case.

Figure 18:
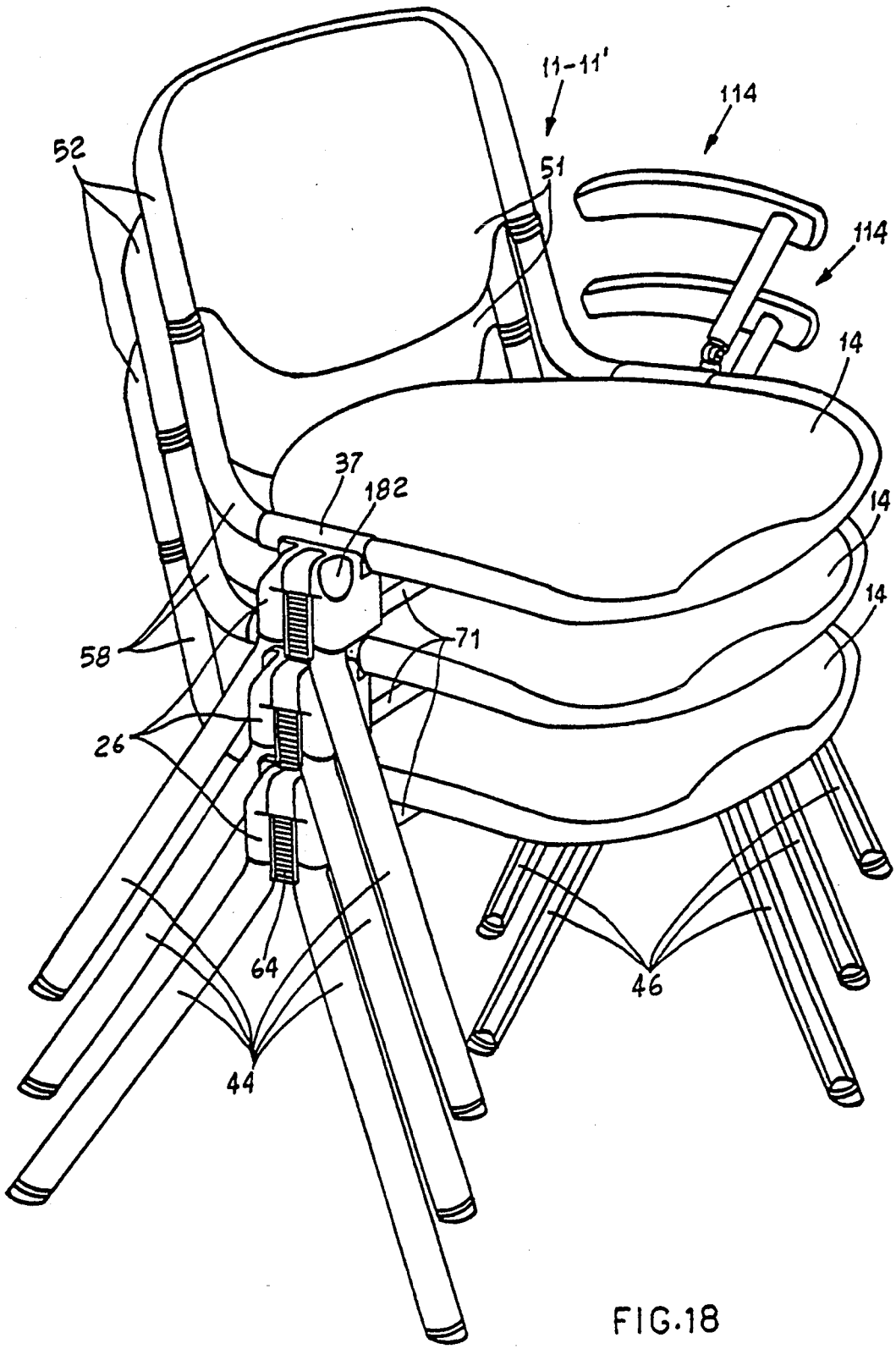
FIG. 18 represents a perspective view of another means of applying the chair according to the invention.

The armrest 114 can be moved from a vertical position, shown in FIG. 10 by a solid line, to an inclined positioned determined and defined by the bevel 133 on the fork 119, shown by a dot and line, in order to allow the chair 11 or 11' to be stacked on top of one another as shown in FIG. 18.

The clasping system 111 works as follows.

As described above, the support and clasping element 66 is attached on the nucleus 26, and the support and clasping element 67 is attached on the nucleus 27. The clasping system 111, which is fastened to the armrest 114, is positioned aligned with the hollow slot of the sleeve 112. The armrest 114 is pushed downward lightly, sliding the clasping device 111 down until it is positioned in its working position, in which the lower end of the piston 118 protrudes from the sleeve 113. The two chairs 11 or 11' are thus permanently attached to each other.

In order to position the armrest 114 in the inclined position, one proceeds as follows.

The piston 118 is pushed upward against the action of the springs 129 and 132, and the positioning pin 126 slips out of the groove 127. The armrest 114 is raised while the positioning pin 126 moves out of the horizontal hole 124, and due to the action of its spring 132 it rests on the outer surface of the small cylinder 117, until it fits into a second horizontal hole 134, to rest with its end fitted into the radial groove 128. The armrest 114 may now rotate around the pin 121 until it settles against the bevel 133. Even when the armrest 114 is in the inclined position, the clasping element 116 remains fitted into the slot of the sleeve 113.

In order to return the armrest 114 into its original position, one follows the above operations in reverse order: thus the armrest 114 is rotated to a vertical position and pressed downward. The positioning pin 126 slips out of the groove 128 and the horizontal hole 134 until it returns into the horizontal hole 124 and the groove 127.

If one wishes to remove the clasping device 111, one proceeds as described above to position the armrest 114 in the inclined position, then a screwdriver or similar tool may be used to push on the lower part of the piston 118, to move the positioning pin 126 out of the groove 128 and the horizontal hole 134. The armrest 114 is now free to be lifted, and thus the clasping system 111 is not fitted into the sleeves 113 and 112, and the two chairs 11 or 11' are separate from one another.

Figure 16:
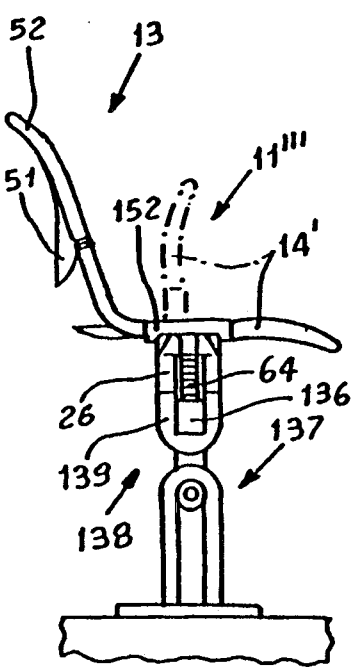
FIGS. 13, 14, 15 and 16 represent partial schematic views of some variations of applying the chair according to the invention.
Figure 15:
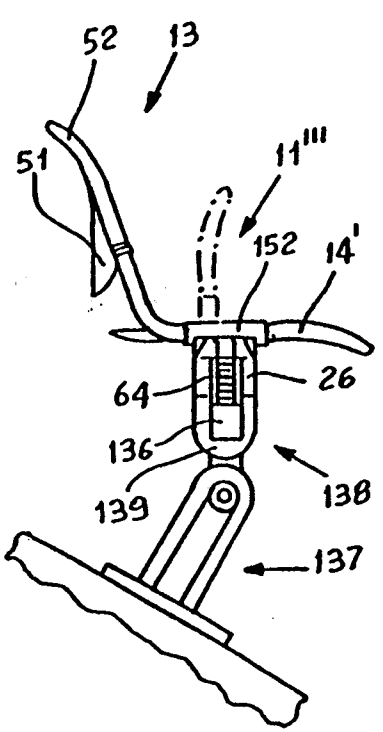
Figure 14:
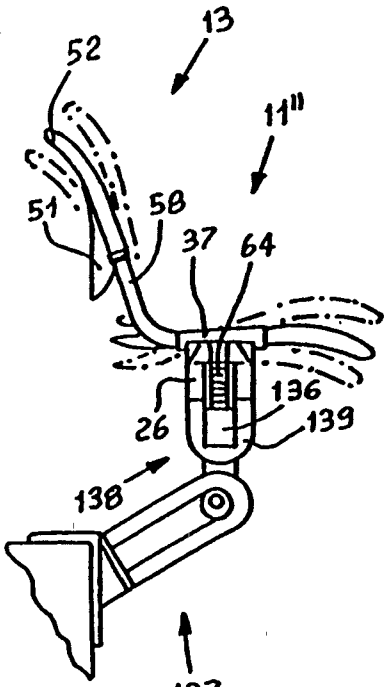
Figure 13:
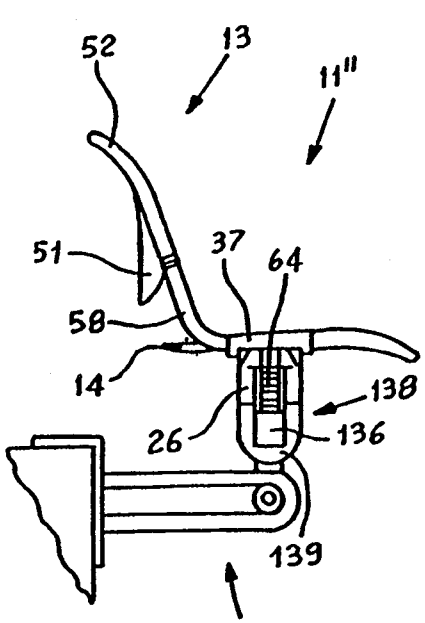

In a variation, a chair 11'', similar to the chairs 11 and 11' but without the legs 44 and 46, may be attached to a bar 136 (FIGS. 13 and 14) for use in collective areas, in particular waiting rooms, cafeterias, classrooms and meeting rooms. The bar 136 is a normal square bar mounted on mobile bases, known on their own merit and indicated generically by the number 137, to be attached either to the floor (FIG. 16), even with variable inclination (FIGS. 14 and 15), or on terraced floorings (FIG. 13).

Even in this variation, the chair 11'' (FIGS. 1, 2, 3, 6, 11, 13 and 14) is substantially identical to the chairs 11 and 11' described above, with the exception of the base structure 138, which includes two U-forks 139 for each chair 11''. Each U-fork 139 includes a square slot 141 to be coupled with the outer surface of the bar 136, two cylindrical pins 142, similar to the pins 18 and 19, to fit into the cylindrical slots 28 of the lower surface 31 of each nucleus 26, 27 along the basic coupling axes 23. The fork 139 also has two appendices 143, each consisting of a square profile, which replace the ends 71 and 72 of the cross-pieces to fit into the side grooves 68 and 69 of the nuclei 26 and 27, each having a through hole 144 for the screws 43.

The assembly of the chair 11'' on the bar 136 is essentially the same as described above for the chairs 11 and 11'. The seating structure 13 is attached to the tabs 39 and 41, fastened to the pins 21 and 22, using the screws 42, and then to the nuclei 26 and 27, which are then rested on the bar 139. The U-forks 136 are mounted with the slots 141, which fit onto the bottom portion of the bar 136; the pins 142 fit into the slots 28, the appendices 143 are housed in the side grooves 68 and 69 of the nuclei 26 and 27. Next the screws 43 are screwed on to hold the seating structure 13, the nuclei 26 and 27 and the appendices 143 of the U-fork 139 fastened to the bar 136.

Chair With Tip-Up Seat

In another variation, a chair 11''' (FIGS. 1, 2, 6, 10, 11, 12, 13, 14, 15 and 16), similar to the chairs 11, 11' and 11'' described above, is mounted on the bar 136 for collective areas, in particular for classrooms, conference rooms, convention halls and amphitheatres. The bar 136 is mounted on the mobile bases 137 to be attached to the floor, even at variable inclinations, or on terraced floors like the chair 11''.

The chair 11''' includes the seating structure 13 with the backrest 51 described above, attached to the side arms 58 and 59, and a tip-up seat 14' with tubular side borders 151. The seating structure 13 is connected to the nuclei 26 and 27 by two fixed intermediate pieces 146, 147 and two tipping intermediate pieces 148, 149. The pieces 146, 147 are "$\pi$"-shaped like parts 35 and 40, and include the sleeves 152 and 153 at the top, respectively. The arms 58 and 59 have the pins 61 and 62 adjacent to the borders 151, fitted into the two sleeves 152 and 153. Each sleeve 152, 153 is attached to the pins 154 and 156, similar to the pins 21 and 22, which are fitted into the slots 29 on the upper surfaces 32 of the nuclei 26 and 27 along the seat coupling axes 24. Screws, similar to the screws 42 and not shown in the drawings, hold the pins 61 and 62 of the arms 58 and 59 in each sleeve 152, 153.

The tipping parts 148 and 149 are T-shaped like the parts 81 and 82, and include a concave flange 157 and 158 at the top, a central drum 162, 163 and a sleeve 164, 166 opposite the flange 157, 158.

The tip-up seat 14' is attached by means of the two side borders 151 on the two flanges 157 and 158 of the parts 148, 149 by means of the screws 42. Each sleeve 164, 166 has a cylindrical slot 167, 168 and is housed in the slot 93 of the nucleus 26, 27 with a coupling that rotates along the horizontal seat coupling axes 90, and each cylindrical slot 167, 168 fits onto the pin 94 of the nucleus 26, 27. As these parts are metal, the bushing 98 of grip-proof material is placed on the pin 94 to prevent gripping between the slot 167, 168 and the pin 94.

Flexible means consisting of two spiral springs 169 and 171, each applied between the sleeve 164, 166 and a groove 172 of the nucleus 26, 27 normally keep the tip-up seat 14' in the tipped position. The sleeve 164, 166 includes three slots 173 in different angular positions to house one end of the spring 169, 171 so as to increase or decrease the tension of the spring 169, 171. Each sleeve 152, 153 has a shoulder 174 positioned during use on the inner side of the chair 11''' to work with the seat 14' and keep it in the seating position. The shoulder 174 has a hole 176 to house a pad 177 of plastic for rubber to soften the contact between the flange 157, 158 and the shoulder 174. In addition, each sleeve 152, 153 is closed at the front by a cap 178, which bears a number so that the chairs 11''' can be numbered progressively.

The assembly of the chair 11''' on the bar 136 is essentially the same as described above for the chairs 11, 11', and 11''. The seat 14' is attached to the two flanges 157 and 158 of the T-levers 148 and 149 by means of the screws 42. The bushing 98 is mounted on the pin 94, the sleeve 164, 166 is positioned in the slot 93 of the nuclei 26 and 27, taking care to position the springs 169 and 171 with their ends in one of the slots 173 and the other end in the grooves 172 of the nuclei 26 and 27. Using the screws 97, the intermediate pieces 148 and 149 are attached axially to the nuclei 26 and 27 so that they may rotate without slipping out of the slots 93 and off the pins 94.

The backrest 51 is mounted on the arms 58 and 59, and the pins 61 and 62 are positioned in the sleeves 152 and 153, attaching them with the screws 42. The pins 154 and 156 are housed in the slots 29 of the upper surfaces 32 of the nuclei 26 and 27, and then the two nuclei 26 and 27 are positioned on the bar 139. The U-forks 136 are mounted with the slots 141 which fit onto the outer part of the bar 136, the pins 142 rest in the slots 28 of the lower surfaces 31, and the appendices 143 in the side grooves 68 and 69 of the nuclei 26 and 27. Next the screws 43 are positioned, which fit and are screwed into the threaded slots 179 of the pins 154 and 156, tightening the bar 139 between the bottom of the forks 136 and the lower part of the nuclei 26 and 27. The chair 11''' is thus mounted on the bar 136.

The chair 11—11' shown in FIG. 17 may have the seating structure 13 firmly attached to the base structure 12, like the chair 11 in FIG. 1, or it may have the seating structure 13 rock with respect to the base structure 12, like the chair 11' in FIG. 6. In addition, the base structure 12 may have legs as shown in FIGS. 1, 5 and 6.

The chair 11—11' is shown with two arms 114 as an example and not intended as a limitation, in order to point out the flexibility of the chairs described thus far. Indeed, using the intermediate parts 35, 40; 81, 82; 146, 147 and 148, 149 and various closing elements 64, 66 and 67, it is possible to obtain an infinite series of chairs, such as: chair with fixed seating structure without armrests, with a single armrest, with two armrests; chair with rocking seating structure without armrests, with a single armrest, with two armrests; chair attached in a row, fixed, overlapping or tip-up tables, etc. In order to better emphasize the above, the chair 11 in FIG. 1 and the chair 11' in FIG. 6 have been shown with the closing element 64 described previously. Simply by replacing the closing element 64 with the support and clasping element 66, described in FIG. 10, and inserting the armrest 114 with the clasping element 111, it is possible to achieve the chairs 11 and 11' with a single armrest 114. Or by assembling the two support and clasping elements 68 on the two nuclei 26 and 27 and inserting the two armrests 114 with the clasping elements 111, the chair 11—11' in FIG. 17 is obtained.

As described earlier, the two armrests 114 may be moved to an inclined position by means of the clasping element 111 of each armrest 114 in order to stack the chairs 11 and 11' on top of each other as indicated in FIG. 18. For this purpose, the nuclei 26 and 27 have two inclined surfaces 182 on the top to work with the inner portion of the legs 44 and 46 to allow and assist the stacking of these chairs.

Finally, each armrest 114 contains, in the upper part consisting of a resting border 183, a slot 184 closed by a removable cap 186, to allow a revolving writing table 187 to be inserted and attached; such a table is prior art and not described nor shown in detail.

It is therefore evident that the base structure 12, the seating structure 13 and the two connecting nuclei 26 and 27 include a series of pins 18, 19, 21 and 22, a series of slots 28, 93 and 102, and a series of grooves 63, 68, 69 which work together, and with connecting and fastening parts, so as to allow the rapid assembly of a series of chairs with varying configurations and performance, using a limited number of pieces and parts.

It is understood that a number of changes and improvements, both in shape and in the arrangement of the various parts, may be made to the chairs 11, 11', 11'' and 11''', the base structure 12 and seating structure 13, the connecting nuclei 26 and 27, the connecting and clasping systems and the assembly sequences described above, without overstepping the limitations of the present invention.

We claim:

1. Chair comprising:

a base structure;

a seating structure with a seat having a predetermined depth, the seating structure includes a tip-up seat and a backrest with two side arms, the base structure and the seating structure each include two coupling parts which extend along corresponding extension axes, said coupling parts of said base structure being separate and independent of said coupling parts of said seating structure, each said coupling part of said seating structure including an arm coupling part and a seat coupling part, the arm coupling part being permanently fixed to the seating structure, means for connecting the base structure and the seating structure, the means for connecting including two connecting nuclei arranged at sides of the base and seating structures, having a limited depth with respect to the depth of the seat, and each connecting nucleus includes a base coupling counter means for coupling with one said coupling part of the base structure and a seat coupling counter means for coupling with one said coupling part of the seating structure, respectively, along respective base and seating coupling axes, each said nucleus including a seat coupling counter means, the seat coupling part of each said coupling part of said seating structure being rotatably coupled to the seat coupling counter means along an axis which is horizontal and perpendicular to a vertical plane of symmetry, so as to allow said seat to be freely tipped and which allows the seating structure to rock freely with respect to said nuclei, and the coupling axes of the seating structure are aligned and are horizontal and perpendicular to a vertical plane of symmetry of the chair.

2. Chair as per claim 1, further including two intermediate parts attached to sides of the seat, each said intermediate part including one said arm coupling part and one said seat coupling part rotatably coupled to the seat coupling counter means.

3. Chair comprising:

a base structure, the base structure including two pairs of upper protrusions as two base coupling parts which extend along extension axes, a seating structure with a seat having a predetermined depth, the seating structure being rockable with respect to a horizontal axis, the seating structure including two side protrusions as two seat coupling parts which extend along extension axes and which define an axis of a T-lever having an upper part which includes a flange attached to a side border of the seating structure, said coupling parts of said base structure being separate and independent of said coupling parts of said seating structure, and means for connecting the base structure and the seating structure, the means for connecting including two connecting nuclei arranged at sides of the base and seating structures, having a limited depth with respect to the depth of the seat, and each connecting nucleus includes one coupling counter means for coupling with one said coupling part of the base structure and another coupling counter means for coupling with one said coupling part of the seating structure, respectively, along respective base and seating coupling axes, each connecting nucleus having:

two lower slots fit onto the two pairs of upper protrusions of the base structure, a side part in which the side parts work with the side protrusions of the seating structure to define said horizontal axis, and two upper slots, a guide pin in each said side slot, said guide pin being perpendicular to a plane passing through the two upper slots, and flexible means for maintaining the seat in an essentially horizontal position, said flexible means including two pairs of springs housed in the upper slots of the connecting nuclei.

4. Chair as per claim 3, further including two pairs of pistons housed in said upper slots, and wherein said springs apply a biasing force on said flanges through said two pairs of small pistons, each said side protrusion includes a sleeve, and each said side part includes a slot to house one said sleeve.

5. Chair as per claim 4, wherein each of the two connecting nuclei has a side surface containing one said side part, the upper and lower slots are essentially cylindrical and parallel, and have an axis, and said side slot includes a cylindrical housing with an axis resting on a plane perpendicular to the axes of the lower and upper slots.

6. Chair comprising:

a base structure, a seating structure with a seat having a predetermined depth, said seating structure including:

a tip-up seat with side borders, a backrest, two side arms which end adjacent to the side borders of the tip-up seat and which are attached to the backrest, a T-lever attached to each said side border of the seat to permit tipping of the seat, each said T-lever including a side protruding part extending along an axis, each said side protruding part including a sleeve with a cylindrical slot, the base structure and the seating structure each include two coupling parts which extend along corresponding extension axes, said coupling parts of said base structure being separate and independent of said coupling parts of said seating structure, the base structure and the two side arms each include two pairs of said coupling parts which extend along corresponding parallel axes, means for connecting the base structure and the seating structure, the means for connecting including two connecting nuclei arranged at sides of the base and seating structures, having a limited depth with respect to the depth of the seat, and each connecting nucleus includes one coupling counter means for coupling with one said coupling part of the base structure and another coupling counter means for coupling with one said coupling part of the seating structure, respectively, along respective base and seating coupling axes, each connecting nucleus having:

two lower slots which receive one pair of protruding coupling parts of the base structure, two upper slots which receive one pair of protruding coupling parts of said arms along said axes, and a side part which works together with one said side protruding part, the latter having its axis resting on a plane perpendicular to said parallel axes, and each said side part including a slot to house one said sleeve and a pin which may be coupled to the cylindrical slot of the sleeve, and flexible means positioned between said sleeve and said guide pin to keep the seat in a tipped position.

7. Chair as per claim 6, further including an arm sleeve which houses and holds the ends of each said arm and wherein each pair of coupling parts of said two arms includes two pins protruding downward into said upper slots and attached to one said arm sleeve.

8. Chair as per claim 7, wherein each pair of coupling parts of said two arms includes a shoulder positioned on an inner side thereof, which works together with the seat to keep the latter in a seating position.

9. Chair to be connected to an adjacent chair of the same construction, in a row, comprising:

a base structure, a seating structure with a seat having a predetermined depth, the base structure and the seating structure each include two pairs of coupling parts which extend along corresponding extension axes, said coupling parts of said base structure being separate and independent of said coupling parts of said seating structure, and means for connecting the base structure and the seating structure, the means for connecting including two connecting nuclei arranged at sides of the base and seating structures, having a limited depth with respect to the depth of the seat, and each connecting nucleus one coupling counter means for coupling with one said coupling part of the base structure and another coupling counter means for coupling with one said coupling part of the seating structure, respectively, along respective base and seating coupling axes, each nucleus having:

two lower counter means which may be interlocked with two said coupling parts of the base structure, and two upper counter means which may be interlocked with two said coupling parts of the seating structure, and clasping means for connecting said chair to the adjacent chair, said clasping means including:

an external side slot of each said nucleus, adjacent to the two lower counter means, a first element which may be interlocked with the external side slot of a second one of said connecting nuclei, the first element having a first complementary part, a second element which may be interlocked with the external side slot of a first one of said connecting nuclei of the adjacent chair, the second element having a second complementary part, in which the first complementary part of the first element may be coupled to the second complementary part of the second element of the adjacent chair, and an armrest provided with a clasping element which works with the complementary part of the first element of the above-mentioned chair and the complementary part of the second element of the adjacent chair, so as to keep the above chair permanently attached to the adjacent chair in the row.

10. Chair as per claim 9, wherein the first element includes a single, nearly prismatic piece, having said first complementary part formed by a hollow sleeve, protruding at a side of said first element and positioned at an upper part of the first element, the second element includes a single, nearly prismatic piece having the second complementary part formed by a hollow sleeve, protruding at side of said second element and positioned at a lower part of the second element in such a way that the sleeves of said first and second complementary parts are concentric in a vertical plane when the above-mentioned chair is moved next to the adjacent chair in the row, to permit said clasping element to be inserted through said sleeves of said first and second complementary parts to connect said chair and said adjacent chair.

11. Chair comprising:

a bar mounted on at least one base which can be attached to a floor, a base structure, a seating structure with a seat having a predetermined depth, the base structure including holding means for holding the seating structure to the bar, the base structure and the seating structure each include two coupling parts which extend along corresponding extension axes, said coupling parts of said base structure being separate and independent of said coupling parts of said seating structure, means for connecting the base structure and the seating structure, the means for connecting including two connecting nuclei arranged at sides of the base and seating structures, having a limited depth with respect to the depth of the seat, and each connecting nucleus includes one coupling counter means for coupling with one said coupling part of the base structure and another coupling counter means for coupling with one said coupling part of the seating structure, respectively, along respective base and seating coupling axes, said means for connecting connects the seating structure and the holding means, the seating structure and the holding means each include two pairs of said coupling parts which extend along the corresponding coupling axes, each nucleus having two lower slots which may interlock with two of said coupling parts of the holding means, and two upper slots which may be interlocked with two of said coupling parts of the seating structure along said axes; and said holding means including a pair of U-forks which are fitted onto the bar, each said U-fork having two of said coupling parts formed by two cylindrical pins which fit into the two lower slots of the respective coupling nucleus.

12. Chair as per claim 11, wherein the seat of said seating structure includes a tip-up seat having side borders, a fixed backrest with two side arms which end adjacent to the side borders of the tip-up seat, backrest holding means for holding the fixed backrest to the bar, and a T-lever attached to each said side border of the seat to permit tipping of the seat, each said T-lever including a side protruding part extending along an axis, the two side arms each include two pairs of said coupling parts, and each nucleus further includes a side part fit together with one said side protruding part.

13. Chair as per claim 12, wherein each said side protruding part includes a sleeve with a cylindrical slot, each said side part includes a slot to house said sleeve and a pin which may be coupled to the cylindrical slot of the sleeve, and further including flexible means applied between said sleeve and said guide pin for keeping the seat in a tipped position;

means for keeping the two coupling parts of each said pair of U-forks in the lower slots of the two connecting nuclei and the two pairs of coupling parts of the two arms in the upper slots of the two connecting nuclei.

14. Chair as per claim 12, further including a hollow sleeve which houses and holds the ends of each said arm and wherein each pair of coupling parts of said two arms include two pins protruding downward into said upper slots and attached to one said arm sleeve.

15. Chair as per claim 12, wherein each said side protruding part includes a sleeve having a cylindrical slot, and each said side part includes a slot to house said sleeve and a pin that may be coupled to the cylindrical slot of the sleeve.

16. Chair as per claim 12, wherein each pair of coupling parts of said two arms includes a shoulder positioned on an inner side thereof, to work with the seat to keep the seat in a seating position.

17. Chair comprising:

a base structure, a seating structure with a seat having a predetermined depth, a pair of armrests, the base structure and the seating structure each include two pairs of protruding coupling parts which extend along corresponding extension axes, said coupling parts of said base structure being separate and independent of said coupling parts of said seating structure, and means for connecting the base structure and the seating structure, the means for connecting including two connecting nuclei arranged at sides of the base and seating structures, having a limited depth with respect to the depth of the seat, each connecting nucleus includes one coupling counter means for coupling with one said coupling part of the base structure and another coupling counter means for coupling with one said coupling part of the seating structure, respectively, along respective base and seating coupling axes, each connecting nucleus including:

two lower slots which may be interlocked with the two coupling parts of the base structure, two upper slots which may be interlocked with the two protruding coupling parts of the seating structure, an external side slot adjacent to the two lower slots, an interlocking element which may be interlocked with the external side slot of each said coupling nucleus, each interlocking element including a support, and said pair of armrests each include clasping means, which works together with a respective said support, for keeping the respective armrest permanently attached to a respective said coupling nucleus.

18. Chair as per claim 17, wherein each said interlocking element includes a single, nearly prismatic part, each said support includes a hollow sleeve protruding at a side of said interlocking element, and the clasping means includes a jointed part normally positioned inside said sleeve and which permits the armrest to be partially raised and rotated so as to be positioned on an inclined plane with respect to a usage position of the armrest, after the clasping means is slid out of its sleeve, to facilitate stacking of several chairs on top of each other.

19. Chair as per claim 17, wherein each armrest has an upper part opposite the clasping means, a slot in said upper part which allows a writing table to be inserted and assembled therein, and removable cap means for closing said slot when a writing table is not inserted and assembled therein.

* * * * *